US012595946B2

(12) United States Patent
Takagi et al.

(10) Patent No.: US 12,595,946 B2
(45) Date of Patent: Apr. 7, 2026

(54) THERMAL MANAGEMENT SYSTEM AND CONTROL METHOD FOR THERMAL MANAGEMENT SYSTEM

(71) Applicant: TOYOTA JIDOSHA KABUSHIKI KAISHA, Toyota (JP)

(72) Inventors: Isao Takagi, Okazaki (JP); Tarou Furukubo, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 125 days.

(21) Appl. No.: 18/242,176

(22) Filed: Sep. 5, 2023

(65) Prior Publication Data

US 2024/0175612 A1 May 30, 2024

(30) Foreign Application Priority Data

Nov. 28, 2022 (JP) ..... 2022-189198

(51) Int. Cl.
*F25B 45/00* (2006.01)

(52) U.S. Cl.
CPC ..... *F25B 45/00* (2013.01); *F25B 2345/003* (2013.01)

(58) Field of Classification Search
CPC ..... F04D 13/12; F04D 15/00; F04D 15/0072; F25B 25/005; B60H 2001/00928; B60H 1/00885
See application file for complete search history.

(56) References Cited

U.S. PATENT DOCUMENTS

2021/0331554 A1 10/2021 Mancini et al.

FOREIGN PATENT DOCUMENTS

| | | | | |
|---|---|---|---|---|
| CN | 215969506 | U | * | 3/2022 |
| CN | 221764287 | U | * | 9/2024 |
| JP | S53-116501 | A | | 10/1978 |
| JP | H05-169098 | A | | 7/1993 |
| JP | H07-200014 | A | | 8/1995 |
| JP | 2014-005815 | A | | 1/2014 |
| JP | 2020-200797 | A | | 12/2020 |

* cited by examiner

*Primary Examiner* — Ana M Vazquez
(74) *Attorney, Agent, or Firm* — OLIFF PLC

(57) ABSTRACT

A thermal management system includes a thermal management circuit through which a thermal medium flows and an electronic control unit. A first water pump is provided upstream of a second water pump in the direction of flow of the thermal medium with a reservoir tank as a start point when the thermal management circuit is in a series connection state in which the reservoir tank, the first water pump, and the second water pump are connected in series with each other. The electronic control unit drives the first water pump earlier than the second water pump on condition that the thermal management circuit is in the series connection state when the thermal medium is injected into the reservoir tank.

10 Claims, 12 Drawing Sheets

THERMAL MANAGEMENT SYSTEM AND CONTROL METHOD FOR THERMAL MANAGEMENT SYSTEM

CROSS-REFERENCE TO RELATED APPLICATION

This application claims priority to Japanese Patent Application No. 2022-189198 filed on Nov. 28, 2022, incorporated herein by reference in its entirety.

BACKGROUND

1. Technical Field

The present disclosure relates to a thermal management system and a control method for a thermal management system.

2. Description of Related Art

US 2021/0331554 A1 discloses a configuration in which a reservoir and a plurality of pumps are provided on a cooling circuit.

SUMMARY

In cooling circuits according to the related art such as that described in US 2021/0331554 A1, a plurality of pumps is occasionally driven at the same time. Therefore, the pumps are occasionally driven when the pumps are not supplied with a sufficient amount of thermal medium, depending on the flowing state of the thermal medium. In this case, it is conceivable that air enters the pumps. Therefore, the discharge power of the pumps may be lowered, or the pumps may be broken.

The present disclosure provides a thermal management system and a control method for a thermal management system capable of suppressing entry of air into pumps.

A first aspect of the present disclosure relates to a thermal management system including a thermal management circuit and an electronic control unit. The thermal management circuit includes a reservoir into which a thermal medium is injected, a first pump, and a second pump, and is configured to allow the thermal medium to flow through the thermal management circuit. The electronic control unit is configured to control drive of each of the first pump and the second pump. The first pump is provided upstream of the second pump in a direction of flow of the thermal medium with the reservoir as a start point when the thermal management circuit is in a series connection state in which the reservoir, the first pump, and the second pump are connected in series with each other. The electronic control unit is configured to drive the first pump earlier than the second pump on condition that the thermal management circuit is in the series connection state when the thermal medium is injected into the reservoir.

With the thermal management system according to the first aspect of the present disclosure, as described above, the first pump is driven earlier than the second pump on condition that the thermal management circuit is in the series connection state when the thermal medium is injected into the reservoir. Consequently, the thermal medium can be fed to the second pump side by driving the first pump before the second pump is driven compared to when the first pump and the second pump are driven at the same time. As a result, it is possible to suppress the second pump being driven when the second pump is not supplied with a sufficient amount of thermal medium. Consequently, it is possible to suppress entry of air into the second pump.

The thermal management system according to the first aspect may further include a switching unit configured to switch the thermal management circuit between the series connection state and a non-series connection state in which the first pump and the second pump are not connected in series with each other, and to be controlled by the electronic control unit. The electronic control unit may be configured to drive each of the first pump and the second pump on condition that the thermal management circuit is switched from the non-series connection state to the series connection state by controlling the switching unit. With the thermal management system configured as described above, it is possible to suppress each of the first pump and the second pump being driven when the first pump and the second pump are not connected in series with each other. As a result, it is possible to more reliably suppress the second pump being driven when the second pump is not supplied with a sufficient amount of thermal medium.

In the thermal management system according to the first aspect, the electronic control unit may be configured to drive the second pump while the thermal medium that has flowed through the first pump is flowing through the second pump on condition that the thermal management circuit is in the series connection state when the thermal medium is injected into the reservoir. With the thermal management system configured as described above, it is possible to suppress the second pump being driven when the second pump is not supplied with a sufficient amount thermal medium. As a result, it is possible to suppress entry of air into the second pump more reliably.

The thermal management system according to the first aspect may further include a first timer configured to measure a time since the first pump is driven, the electronic control unit may be configured to acquire information about a first predetermined time based on a time required for the thermal medium to flow from the first pump to the second pump, and to drive the second pump in response to the time measured by the first timer exceeding the first predetermined time on condition that the thermal management circuit is in the series connection state when the thermal medium is injected into the reservoir. With the thermal management system configured as described above, the timing to drive the second pump can be controlled easily based on the time measured by the first timer. The first predetermined time may be determined using a learned model generated by a machine learning technique such as deep learning.

The thermal management system according to the first aspect may further include a detection unit configured to detect that the thermal medium has reached the second pump. The electronic control unit may be configured to drive the second pump in response to the detection unit detecting that the thermal medium has reached the second pump on condition that the thermal management circuit is in the series connection state when the thermal medium is injected into the reservoir. With the thermal management system configured as described above, the timing to drive the second pump can be controlled easily based on the result of detection by the detection unit. In addition, the second pump can be driven relatively immediately since the thermal medium reaches the second pump, which can shorten the time for the thermal medium to be distributed in the thermal management circuit.

In the thermal management system configured as described above, the detection unit may be a pressure sensor or a liquid temperature sensor. The electronic control unit may be configured to drive the second pump in response to the pressure sensor or the liquid temperature sensor detecting that the thermal medium has reached the second pump on condition that the thermal management circuit is in the series connection state when the thermal medium is injected into the reservoir. With the thermal management system configured as described above, the timing to drive the second pump can be controlled easily based on the result of detection by the detection unit. In addition, the second pump can be driven relatively immediately since the thermal medium reaches the second pump, which can shorten the time for the thermal medium to be distributed in the thermal management circuit.

In the thermal management system according to the first aspect, the electronic control unit may be configured to drive the first pump while the thermal medium is flowing through the first pump on condition that the thermal management circuit is in the series connection state when the thermal medium is injected into the reservoir. With the thermal management system configured as described above, it is possible to suppress the first pump being driven when the first pump is not supplied with a sufficient amount thermal medium.

In the thermal management system according to the first aspect, the thermal management circuit may further include a second timer configured to measure a time since the thermal medium is injected into the reservoir. The electronic control unit may be configured to acquire information about a second predetermined time based on a time required for the thermal medium to flow from the reservoir to the first pump, and to drive the first pump in response to the time measured by the second timer exceeding the second predetermined time on condition that the thermal management circuit is in the series connection state when the thermal medium is injected into the reservoir. With the thermal management system configured as described above, the timing to drive the first pump can be controlled easily based on the time measured by the second timer. The second predetermined time may be determined using a learned model generated by a machine learning technique such as deep learning.

A second aspect of the present disclosure relates to a thermal management system including a thermal management circuit and an electronic control unit. The thermal management circuit includes a reservoir into which a thermal medium is injected and a plurality of pumps, and is configured to allow the thermal medium to flow through the thermal management circuit. The electronic control unit is configured to control drive of each of the plurality of pumps. The plurality of pumps include a most upstream pump provided most upstream in a direction of flow of the thermal medium with the reservoir as a start point when the thermal management circuit is in a series connection state in which the reservoir and the plurality of pumps are connected in series with each other. The electronic control unit is configured to drive the most upstream pump first, among the plurality of pumps, on condition that the thermal management circuit is in the series connection state when the thermal medium is injected into the reservoir.

With the thermal management system according to the second aspect of the present disclosure, as described above, the most upstream pump that is the most upstream among the plurality of pumps is driven on condition that the thermal management circuit is in the series connection state when the thermal medium is injected into the reservoir. Consequently, the thermal medium can be fed to downstream pumps by driving the most upstream pump before the downstream pumps are driven compared to when the plurality of pumps are driven at the same time. As a result, entry of air into the downstream pumps can be suppressed.

In the thermal management system according to the second aspect, the electronic control unit is configured to drive the plurality of pumps sequentially from an upstream side in the direction of flow on condition that the thermal management circuit is in the series connection state when the thermal medium is injected into the reservoir. With the thermal management system configured as described above, the plurality of pumps can be driven sequentially in the order of arrival of the thermal medium.

A third aspect of the present disclosure relates to a control method for a thermal management system including a thermal management circuit. The thermal management circuit includes a reservoir into which a thermal medium is injected, a first pump, and a second pump, and is configured to allow the thermal medium to flow through the thermal management circuit. The first pump is provided upstream of the second pump with respect to the reservoir in a direction of flow of the thermal medium when the thermal management circuit is in a series connection state in which the reservoir, the first pump, and the second pump are connected in series with each other. The control method includes: (i) injecting the thermal medium into the reservoir on condition that the thermal management circuit is in the series connection state; and (ii) driving the first pump earlier than the second pump when the thermal medium is injected into the reservoir in the injecting of the thermal medium.

With the control method for a thermal management system according to the third aspect of the present disclosure, as described above, the first pump is driven earlier than the second pump on condition that the thermal management circuit is in the series connection state when the thermal medium is injected into the reservoir. Consequently, it is possible to provide a control method for a thermal management system capable of suppressing entry of air into the second pump.

With the thermal management system and the control method for a thermal management system according to the present disclosure, it is possible to suppress entry of air into plurality of pumps.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

A first embodiment of the present disclosure will be described in detail below with reference to the drawings. The same or corresponding parts are denoted by the same signs throughout the drawings, and description thereof will not be repeated.

Hereinafter, a configuration in which a thermal management system according to the present disclosure is mounted on a vehicle will be described as an example. The vehicle is preferably a vehicle on which a battery for travel is mounted, and may be a battery electric vehicle (BEV), for example. The vehicle may be a hybrid electric vehicle (HEV), a plug-in hybrid electric vehicle (PHEV), or a fuel cell electric vehicle (FCEV). However, the thermal management system according to the present disclosure is not limited to use for vehicles.

Figure 1:
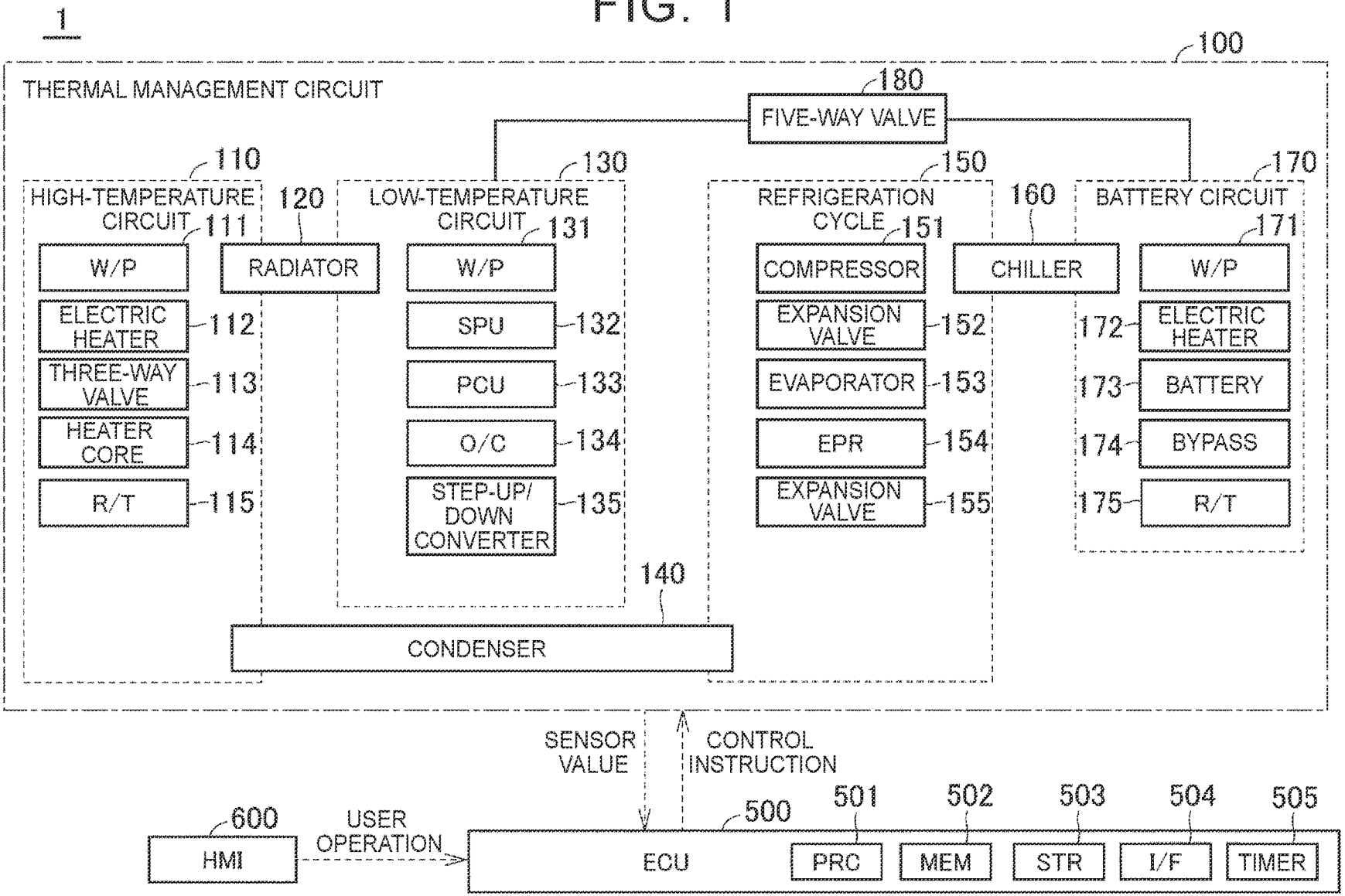
FIG. 1 illustrates the configuration of a thermal management system according to a first embodiment of the present disclosure.

First, the overall configuration of a thermal management system according to the first embodiment of the present disclosure will be described. FIG. 1 illustrates an example of the overall configuration of the thermal management system according to the first embodiment of the present disclosure. The thermal management system 1 includes a thermal management circuit 100, an electronic control unit (ECU) 500, and a human machine interface (HMI) 600. The ECU 500 is an example of an "electronic control unit" according to the present disclosure.

The thermal management circuit 100 is configured to allow a thermal medium to flow therethrough. The thermal management circuit 100 includes a high-temperature circuit 110, a radiator 120, a low-temperature circuit 130, a condenser 140, a refrigeration cycle 150, a chiller 160, a battery circuit 170, and a five-way valve 180, for example. The five-way valve 180 is an example of a "switching unit" according to the present disclosure.

The high-temperature circuit 110 includes a water pump (W/P) 111, an electric heater 112, a three-way valve 113, a heater core 114, and a reservoir tank (R/T) 115, for example. The radiator 120 is connected to (i.e. shared by) both the high-temperature circuit 110 and the low-temperature circuit 130. The radiator 120 includes a high-temperature (HT) radiator 121 and a low-temperature (LT) radiator 122 (see FIG. 2). The low-temperature circuit 130 includes a water pump 131, a smart power unit (SPU) 132, a power control unit (PCU) 133, an oil cooler (O/C) 134, and a step-up/down converter 135, for example. The condenser 140 is connected to both the high-temperature circuit 110 and the refrigeration cycle 150. The refrigeration cycle 150 includes a compressor 151, an expansion valve 152, an evaporator 153, an evaporative pressure regulator (EPR) 154, and an expansion valve 155, for example. The chiller 160 is connected to both the refrigeration cycle 150 and the battery circuit 170. The battery circuit 170 includes a water pump 171, an electric heater 172, a battery 173, a bypass path 174, and a reservoir tank 175, for example. The five-way valve 180 is connected to the low-temperature circuit 130 and the battery circuit 170. The configuration of the thermal management circuit 100 will be described in detail with reference to FIG. 2.

The reservoir tank 175 is an example of a "reservoir" according to the present disclosure. The water pump 171 and the water pump 131 are examples of a "first pump" and a "second pump", respectively, according to the present disclosure. The water pump 171 and the water pump 131 are each an example of a "pump" according to the present disclosure. The water pump 171 is an example of a "most upstream pump" according to the present disclosure.

The ECU 500 controls the thermal management circuit 100. The ECU 500 includes a processor 501, a memory 502, a storage 503, an interface 504, and a timer 505. The timer 505 may be provided separately from the ECU 500. The timer 505 is an example of a "first timer" and a "second timer" according to the present disclosure.

The processor 501 may be a central processing unit (CPU) or a micro-processing unit (MPU), for example. The memory 502 may be a random access memory (RAM), for example. The storage 503 may be a rewritable nonvolatile memory such as a hard disk drive (HDD), a solid state drive (SSD), or a flash memory. The storage 503 stores a system program that includes an operating system (OS), and a control program that includes computer-readable codes that are necessary for control computation. The processor 501 implements various processes by reading the system program and the control program and developing such programs in the memory 502. The interface 504 controls communication between the ECU 500 and constituent components of the thermal management circuit 100. The timer 505 measures an elapsed time since a predetermined process is executed. The function of the timer 505 will be discussed in detail later.

The ECU 500 generates a control instruction based on sensor values (e.g. temperatures at various locations) acquired from various sensors (not illustrated) included in the thermal management circuit 100, a user operation received by the HMI 600, etc., and outputs the generated control instruction to the thermal management circuit 100. The ECU 500 may be divided into a plurality of ECUs by function. While the ECU 500 includes one processor 501 in FIG. 1, the ECU 500 may include a plurality of processors. The same applies to the memory 502 and the storage 503.

Herein, the "processor" is not limited to a processor in the narrow sense that executes a process by a stored program method, and may include hardwired circuitry such as an application specific integrated circuit (ASIC) and a field-programmable gate array (FPGA). Therefore, the term "processor" may be replaced with processing circuitry that executes a process defined in advance by computer-readable codes and/or hardwired circuitry.

The HMI 600 may be a display with a touch panel, an operation panel, a console, etc. The HMI 600 receives a user operation for controlling the thermal management system 1. The HMI 600 outputs a signal that indicates the user operation to the ECU 500.

Figure 2:
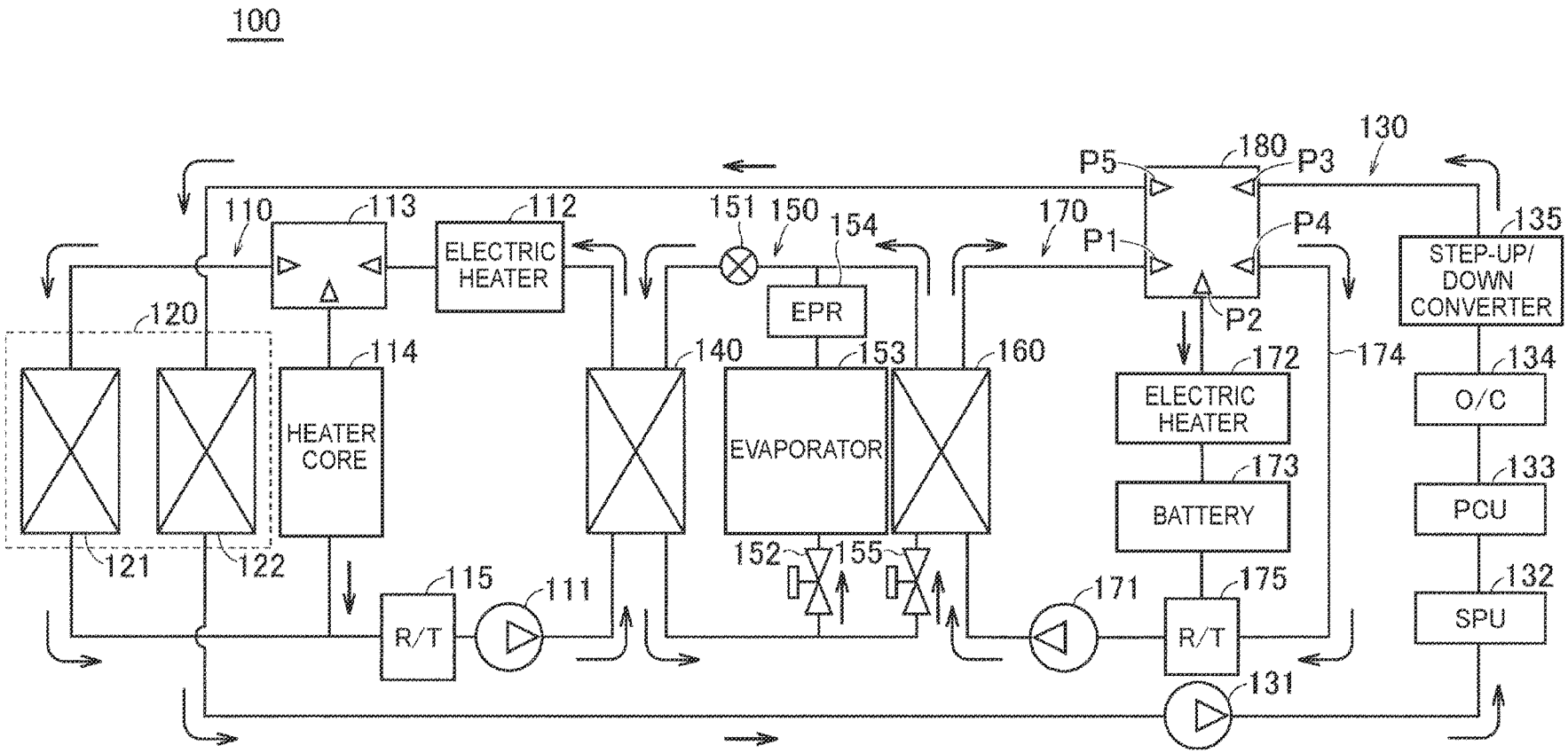
FIG. 2 illustrates the detailed configuration of the thermal management system according to the first embodiment.

Next, the configuration of the thermal management circuit will be described. FIG. 2 illustrates an example of the configuration of the thermal management circuit 100 according to the first embodiment. A thermal medium (normally hot water) that circulates in the high-temperature circuit 110 flows through one or both of a first path of water pump 111—condenser 140—electric heater 112—three-way valve 113—heater core 114—reservoir tank 115—water pump 111 and a second path of water pump 111—condenser 140—electric heater 112—three-way valve 113—high-temperature radiator 121—reservoir tank 115—water pump 111.

A thermal medium (coolant) that circulates in the low-temperature circuit 130 flows through a path of water pump 131—SPU 132—PCU 133—oil cooler 134—step-up/down converter 135—five-way valve 180—low-temperature radiator 122—water pump 131.

The water pump 131 circulates the thermal medium in the low-temperature circuit 130 in accordance with a control instruction from the ECU 500. The SPU 132 controls charge and discharge of the battery 173 in accordance with a control instruction from the ECU 500. The PCU 133 converts direct-current (DC) power supplied from the battery 173 into alternating-current (AC) power and supplies the AC power to a motor (not illustrated) built in a transaxle in accordance with a control instruction from the ECU 500. The oil cooler 134 circulates lubricating oil for the motor using an electrical oil pump (EOP) (not illustrated). The SPU 132, the PCU 133, the oil cooler 134, and the step-up/down converter 135 are cooled by the thermal medium circulating in the low-temperature circuit 130. The five-way valve 180 switches the path of the thermal medium in the low-temperature circuit 130 and the battery circuit 170 in accordance with a control instruction from the ECU 500. The low-temperature radiator 122 is disposed in the vicinity of the high-temperature radiator 121, and exchanges heat with the high-temperature radiator 121.

A thermal medium (gas-phase cooling medium or liquid-phase cooling medium) that circulates in the refrigeration cycle 150 flows through one or both of a first path of compressor 151—condenser 140—expansion valve 152—evaporator 153—EPR 154—compressor 151 and a second path of compressor 151—condenser 140—expansion valve 155 chiller 160—compressor 151.

A thermal medium (coolant) that circulates in the battery circuit 170 flows through one or both of a first path of water pump 171—chiller 160—five-way valve 180—electric heater 172—battery 173—reservoir tank 175—water pump 171 and a second path of water pump 171—chiller 160—five-way valve 180—bypass path 174—reservoir tank 175—water pump 171. The reservoir tank 175 is provided at a portion at which the first path and the bypass path 174 are merged.

The water pump 171 circulates the thermal medium in the battery circuit 170 in accordance with a control instruction from the ECU 500. The chiller 160 cools the thermal medium circulating in the battery circuit 170 through heat exchange between the thermal medium circulating in the refrigeration cycle 150 and the thermal medium circulating in the battery circuit 170. The electric heater 172 heats the thermal medium in accordance with a control instruction from the ECU 500. The battery 173 supplies power for travel to the motor built in the transaxle. The battery 173 may be heated using the electric heater 172 or cooled using the chiller 160. The bypass path 174 is provided to allow the thermal medium to bypass the electric heater 172 and the battery 173. When the thermal medium flows through the bypass path 174, variations in the temperature of the thermal medium due to heat absorption/heat radiation between the thermal medium and the battery 173 can be suppressed. The reservoir tank 175 maintains the pressure and the amount of the thermal medium in the battery circuit 170 by storing a part of the thermal medium in the battery circuit 170.

The five-way valve 180 is provided with five ports P1 to P5. The port P1 is an inlet port into which a thermal medium flows from the chiller 160. The port P2 is an outlet port from which a thermal medium flows toward the electric heater 172 and the battery 173 (the battery 173 is indicated as a representative) of the battery circuit 170. The port P3 is an inlet port into which a thermal medium flows from the SPU 132, the PCU 133, the oil cooler 134, and the step-up/down converter 135 (the PCU 133 is indicated as a representative) of the low-temperature circuit 130. The port P4 is an outlet port from which a thermal medium flows toward the bypass path 174 of the battery circuit 170. The port P5 is an outlet port from which a thermal medium flows toward the low-temperature radiator 122.

Figure 3:
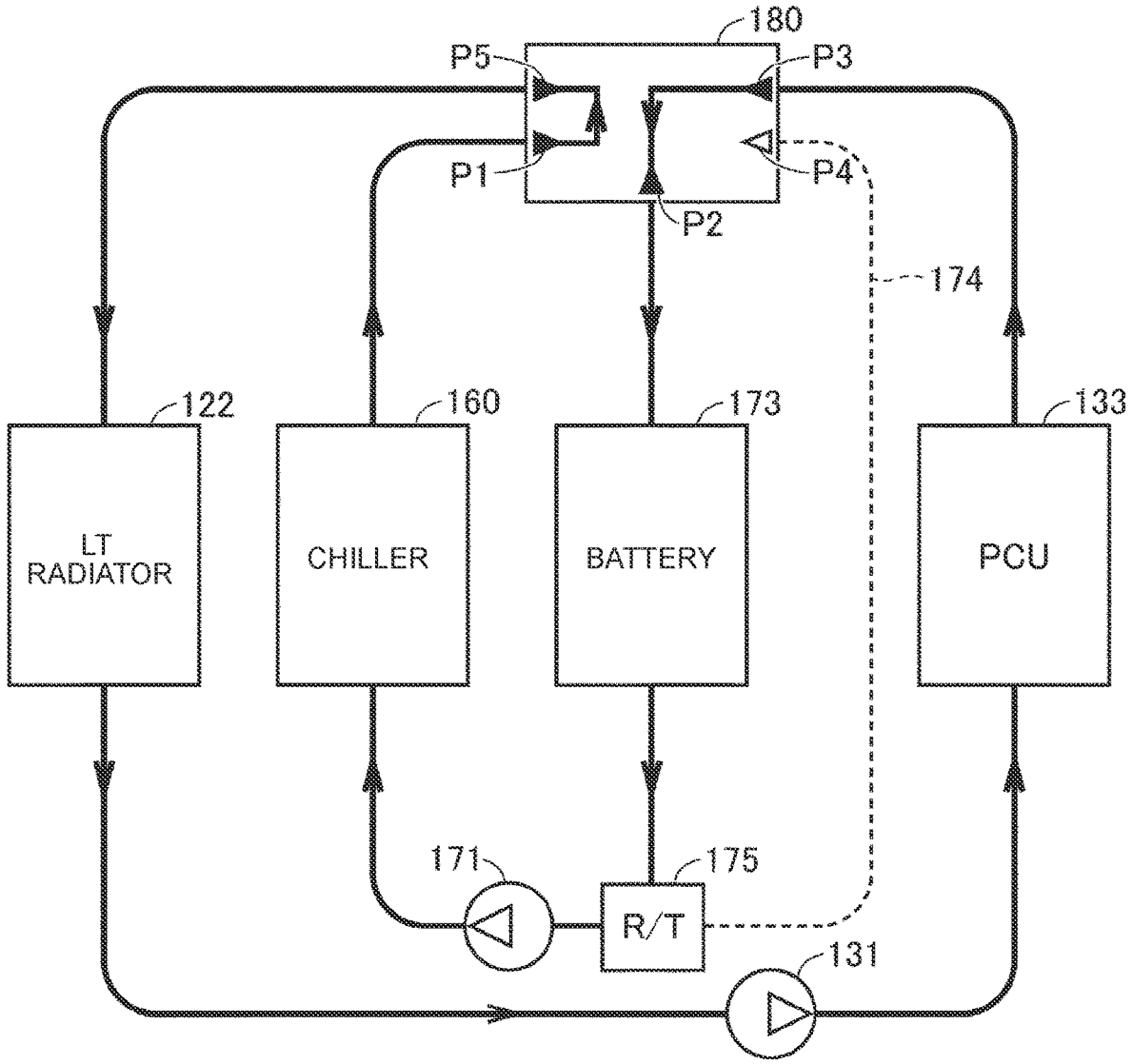
FIG. 3 illustrates an example of the configuration of a thermal management circuit according to the first embodiment in a series connection state.
Figure 4:
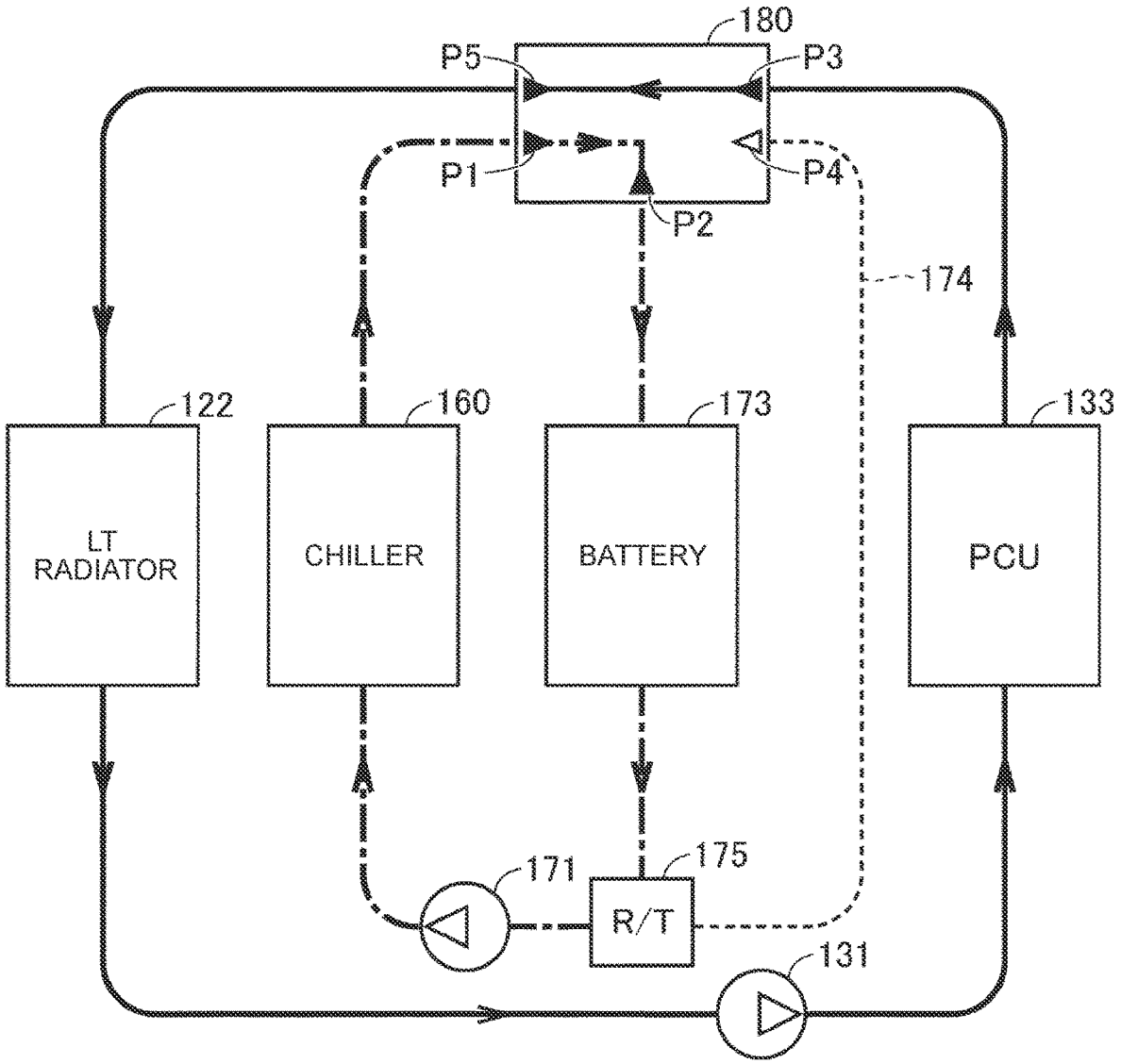
FIG. 4 illustrates an example of the configuration of the thermal management circuit according to the first embodiment in a parallel connection state.

Next, communication patterns will be described. FIGS. 3 and 4 are each a conceptual diagram illustrating an overview of a first communication pattern and a second communication pattern of the five-way valve 180. In the first communication pattern, as illustrated in FIG. 3, the five-way valve 180 forms a path that communicates between the port P1 and the port P5 and a path that communicates between the port P3 and the port P2. In this case, the low-temperature circuit 130 and the battery circuit 170 are connected in series with each other. As a result, the thermal management circuit 100 is in a series connection state in which the reservoir tank 175, the water pump 171, and the water pump 131 are connected in series with each other. In this case, the water pump 171 is provided upstream of the water pump 131 with the reservoir tank 175 as the start point in the direction of flow of the thermal medium.

In the second communication pattern (see FIG. 4), the five-way valve 180 forms a path that communicates between the port P1 and the port P2 and a path that communicates between the port P3 and the port P5. These two paths are independent of each other, and no separate path is formed to connect between the two paths. In this case, the low-temperature circuit 130 and the battery circuit 170 are connected in parallel completely independently. As a result, the thermal management circuit 100 is in a non-series connection state in which the water pump 171 and the water pump 131 are not connected in series with each other (are disposed in parallel).

The thermal medium is injected into the thermal management circuit 100 on condition that the thermal management circuit 100 has been switched to the series connection state (see FIG. 3). First, the thermal medium is injected into the reservoir tank 175. The thermal medium injected into the reservoir tank 175 flows in the order of water pump 171—chiller 160—five-way valve 180—low-temperature radiator 122—water pump 131—PCU 133—five-way valve 180—battery 173—reservoir tank 175. In this event, the five-way valve 180 may be controlled such that the thermal medium flows through the bypass path 174. That is, the thermal medium from the port P3 may be caused to flow through the port P4 in addition to (or in place of) the port P2.

In a thermal management circuit according to the related art, a plurality of pumps in a series state is occasionally driven at the same time when a thermal medium is injected into a reservoir tank. Therefore, the pumps are occasionally driven when the pumps are not supplied with a sufficient amount of thermal medium, depending on the flowing state of the thermal medium. In this case, it is conceivable that air enters the pumps. Therefore, the discharge power of the pumps may be lowered, or the pumps may be broken Thus, it is desired to suppress the pumps being driven when the pumps are not supplied with a sufficient amount of thermal medium.

Thus, in the first embodiment, the ECU 500 drives the upstream water pump 171 earlier than the downstream water pump 131 on condition that the thermal management circuit 100 is in the series connection state when the thermal medium is injected into the reservoir tank 175. In this example, the ECU 500 drives the downstream water pump 131 a predetermined time after driving the upstream water pump 171.

Specifically, the ECU 500 drives the water pump 171 while the thermal medium is flowing through the water pump 171 on condition that the thermal management circuit 100 is in the series connection state when the thermal medium is injected into the reservoir tank 175. That is, the ECU 500 drives the water pump 171 after the thermal medium injected into the reservoir tank 175 reaches the water pump 171. A predetermined time after that, the ECU 500 drives the water pump 131 while the thermal medium that has flowed through the water pump 171 is flowing through the water pump 131. That is, the ECU 500 drives the water pump 131 after the thermal medium that has flowed through the water pump 171 reaches the water pump 131.

This control may be implemented as follows. When the thermal medium is injected into the reservoir tank 175, an operator performs a predetermined operation on the HMI 600. The timer 505 measures the time since the predetermined operation is performed in response to the predetermined operation being performed. Consequently, the time since the thermal medium is injected into the reservoir tank 175 is measured by the timer 505. The time measurement by the timer 505 may be started in response to a signal from a sensor that detects that the thermal medium is injected into the reservoir tank 175.

Then, the ECU 500 (processor 501) drives the water pump 171 when the elapsed time since the thermal medium is injected into the reservoir tank 175 exceeds a predetermined value A1 (e.g. 1 minute). The predetermined value A1 is a value that is equal to or more than the time required for the thermal medium to reach the water pump 171 since the thermal medium is injected into the reservoir tank 175. The predetermined value A1 may be a value set in advance based on the results of experiments at the time of manufacture of the thermal management system 1. Consequently, the water pump 171 is driven after the thermal medium reaches the water pump 171. The processor 501 acquires information on the predetermined value A1 stored in the memory 502 of the ECU 500 to perform the above control. The predetermined value A1 is an example of a "second predetermined time" according to the present disclosure.

The timer 505 also measures the time since the water pump 171 is driven. Then, the ECU 500 drives the water pump 131 when the elapsed time since the water pump 171 is driven exceeds a predetermined value B1 (e.g. 3 minutes). The predetermined value B1 is a value that is sufficiently greater than the time required for the thermal medium to reach the water pump 131 after being discharged from the water pump 171. The predetermined value B1 may be a value set in advance based on the results of experiments at the time of manufacture of the thermal management system 1. Consequently, the water pump 131 is driven after the thermal medium reaches the water pump 131. The processor 501 acquires information on the predetermined value B1 stored in the memory 502 of the ECU 500 to perform the above control. The predetermined value B1 is an example of a "first predetermined time" according to the present disclosure.

The water pump 131 may be driven based on the elapsed time since the thermal medium is injected into the reservoir tank 175 instead of driving the water pump 131 based on the elapsed time since the water pump 171 is driven. In addition, a timer that measures the elapsed time since the thermal medium is injected into the reservoir tank 175 and a timer that measures the time since the water pump 171 is driven may be provided separately.

Figure 5:
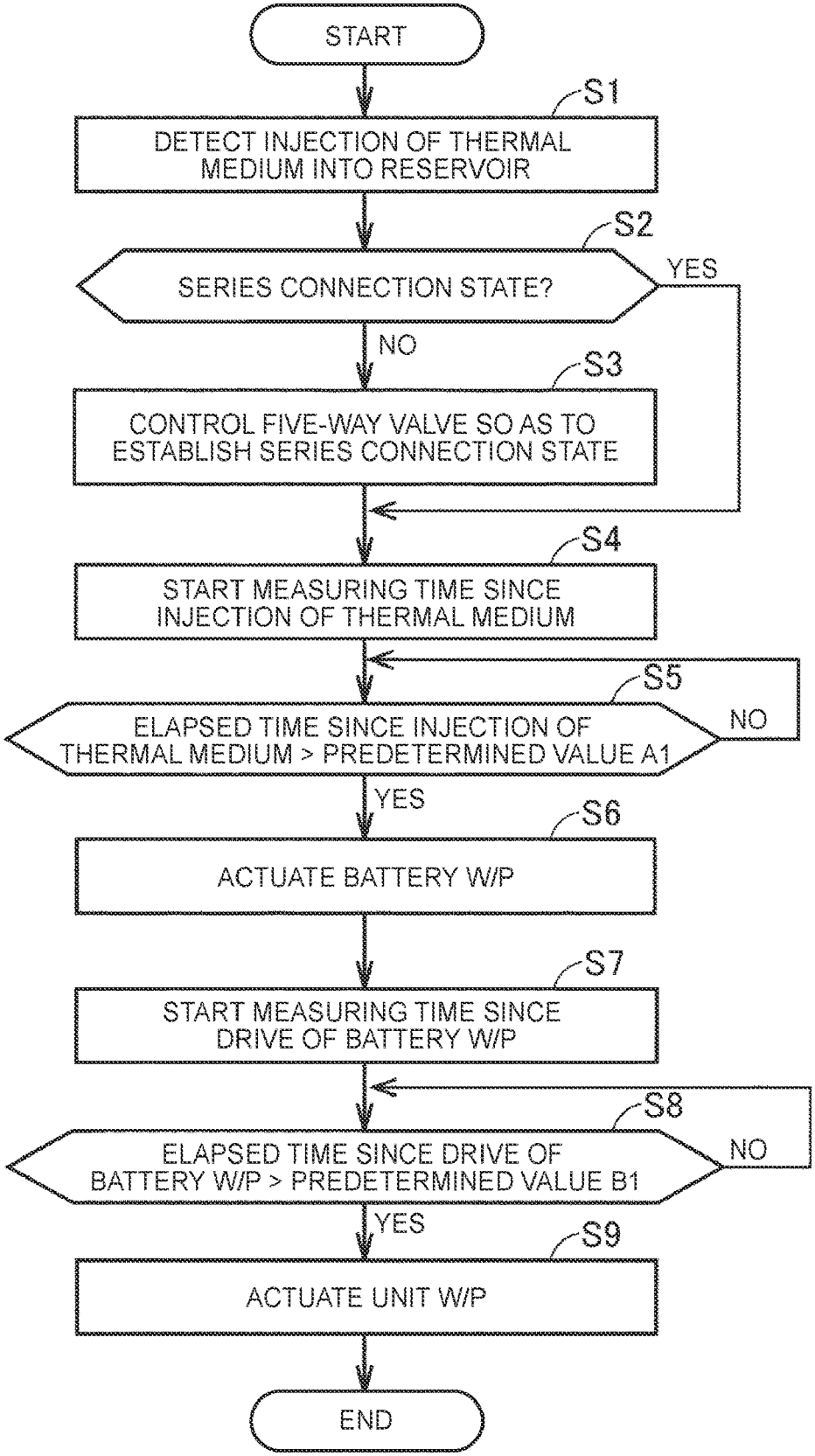
FIG. 5 is a flowchart illustrating a control flow for the thermal management system according to the first embodiment.

Next, a control method for the thermal management circuit will be described. A control method for the thermal management system 1 (drive method for the water pump 131 and the water pump 171) will be described with reference to the flowchart in FIG. 5.

In step S1, the ECU 500 (processor 501) detects that a thermal medium has been injected into the reservoir tank 175 in response to the HMI 600 receiving a predetermined operation by an operator, for example.

In step S2, the ECU 500 determines whether the thermal management circuit 100 is in the series connection state. For example, the ECU 500 determines whether the thermal management circuit 100 is in the series connection state based on the state of the five-way valve 180. When the thermal management circuit 100 is in the series connection state (Yes in S2), the process proceeds to step S4. When the thermal management circuit 100 is in the non-series connection state (No in S2), the process proceeds to step S3.

In step S3, the ECU 500 controls the five-way valve 180 such that the thermal management circuit 100 is in the series connection state.

In step S4, the ECU 500 controls the timer 505 so as to start measuring the time since injection of the thermal medium into the reservoir tank 175 is detected in S1.

In step S5, the ECU 500 determines whether the elapsed time since injection of the thermal medium into the reservoir tank 175 is detected, measurement of which by the timer 505 has been started in step S4, is greater than the predetermined value A1. When the elapsed time is greater than the predetermined value A1 (Yes in S5), the process proceeds to step S6. When the elapsed time is not greater than the predetermined value A1 (No in S5), the process in step S5 is repeatedly performed.

In step S6, the ECU 500 drives the upstream water pump 171 (battery W/P).

In step S7, the ECU 500 controls the timer 505 so as to start measuring the time since the water pump 171 is driven in response to the process in step S6. Specifically, the ECU 500 starts measuring the time using the timer 505 at the timing when a signal indicating that the water pump 171 is driven is received (acquired) from the thermal management circuit 100.

In step S8, the ECU 500 determines whether the elapsed time since the water pump 171 is driven, measurement of which by the timer 505 has been started in step S7, is greater than the predetermined value B1. When the elapsed time is greater than the predetermined value B1 (Yes in S8), the process proceeds to step S9. When the elapsed time is not greater than the predetermined value B1 (No in S8), the process in step S8 is repeatedly performed.

In step S9, the ECU 500 drives the downstream water pump 131 (unit W/P).

In the first embodiment, as described above, the processor 501 drives the water pump 171 earlier than the water pump 131 with the thermal management circuit 100 in the series connection state when the thermal medium is injected into the reservoir tank 175. That is, the pumps 131 and 171 are driven sequentially from the upstream side with the reservoir tank 175 as the start point. Consequently, the pumps can be driven in the order of arrival of the thermal medium. Then, the pump 131 is driven after the thermal medium reaches the pump 131, which suppresses entry of air into the pump 131. As a result, it is possible to suppress a reduction in the discharge power of the pump 131 and a failure of the pump 131.

Next, a thermal management system according to a second embodiment of the present disclosure will be described. In the first embodiment, the five-way valve 180 is used. However, the configuration of the switching unit according to the present disclosure is not limited thereto. In the second embodiment, the switching unit according to the present disclosure is an eight-way valve.

Figure 6:
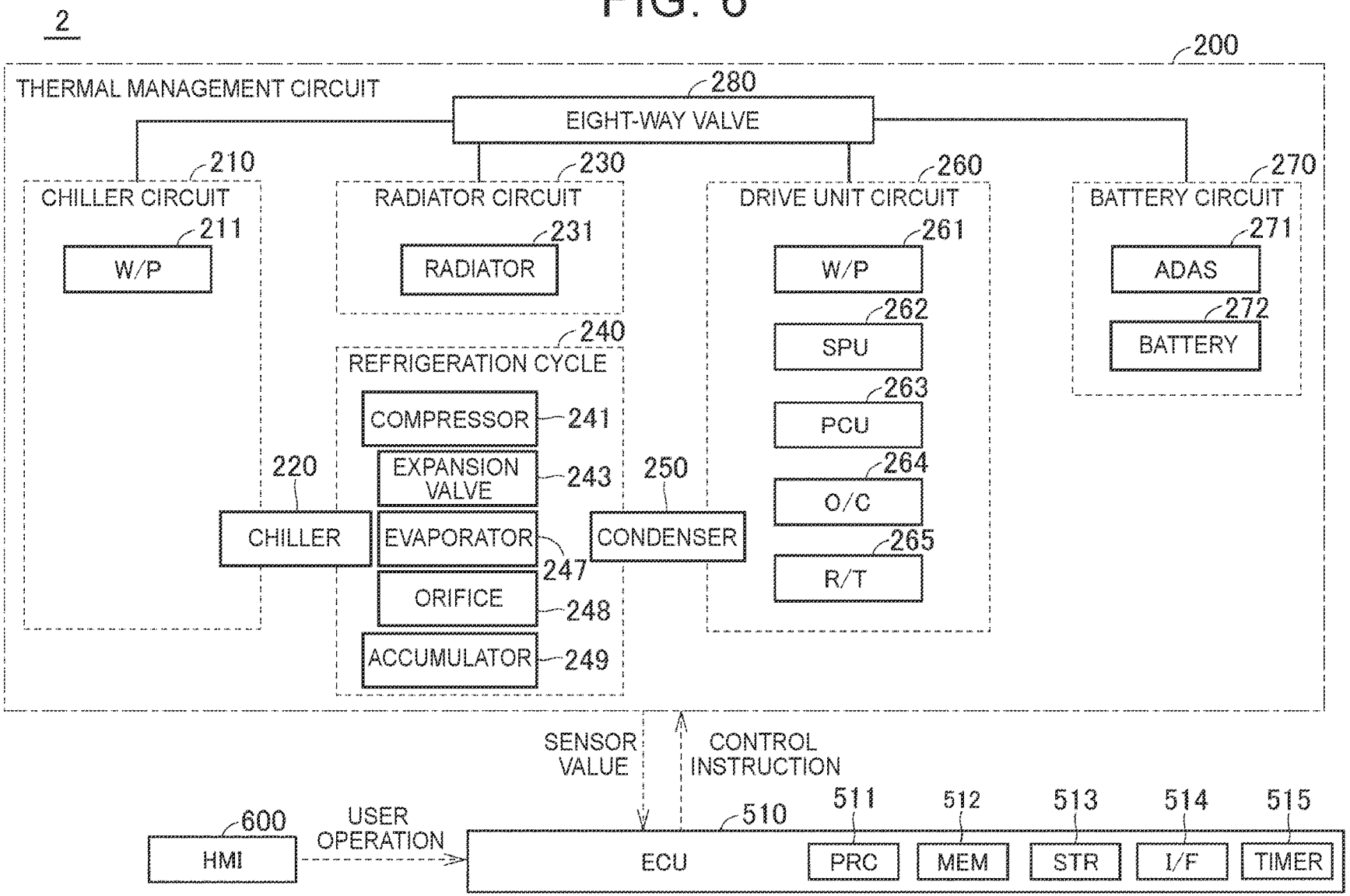
FIG. 6 illustrates the configuration of a thermal management system according to a second embodiment of the present disclosure.

The overall configuration of the thermal management system according to the second embodiment of the present disclosure will be described below. FIG. 6 illustrates an example of the overall configuration of the thermal management system according to the second embodiment of the present disclosure. A thermal management system 2 is different from the thermal management system 1 (see FIG. 1) according to the first embodiment in including a thermal management circuit 200 in place of the thermal management circuit 100 and including an ECU 510 in place of the ECU 500. The ECU 510 is an example of an "electronic control unit" according to the present disclosure.

The thermal management circuit 200 includes a chiller circuit 210, a chiller 220, a radiator circuit 230, a refrigeration cycle 240, a condenser 250, a drive unit circuit 260, a battery circuit 270, and an eight-way valve 280, for example. The eight-way valve 280 is an example of a "switching unit" according to the present disclosure.

The chiller circuit 210 includes a water pump (W/P) 211. The chiller 220 is connected to (shared by) both the chiller circuit 210 and the refrigeration cycle 240. The radiator circuit 230 includes a radiator 231. The refrigeration cycle 240 includes a compressor 241, an electromagnetic valve 242 (see FIG. 7), an expansion valve 243, electromagnetic valves 244A, 244B, 245, and 246 (see FIG. 7), an evaporator 247, an orifice (expansion valve) 248, and an accumulator 249, for example. The condenser 250 includes a water-cooled condenser 251 and an air-cooled condenser 252 (see FIG. 7), and is connected to both the refrigeration cycle 240 and the drive unit circuit 260. The drive unit circuit 260 includes a water pump 261, an SPU 262, a PCU 263, an oil cooler 264, and a reservoir tank 265, for example. The battery circuit 270 includes an advanced driver-assistance system (ADAS) 271 and a battery 272, for example. The eight-way valve 280 includes ports P1 to P8 (see FIG. 7), and is connected to the chiller circuit 210, the radiator circuit 230, the drive unit circuit 260, and the battery circuit 270.

The reservoir tank 265 is an example of a "reservoir" according to the present disclosure. The water pump 211 and the water pump 261 are examples of a "first pump" and a "second pump", respectively, according to the present disclosure. The water pump 211 and the water pump 261 are each an example of a "pump" according to the present disclosure. The water pump 211 is an example of a "most upstream pump" according to the present disclosure.

The ECU 510 controls the thermal management circuit 200. The ECU 510 includes a processor 511, a memory 512, a storage 513, an interface 514, and a timer 515. The timer 515 may be provided separately from the ECU 510. The timer 515 is an example of a "first timer" and a "second timer" according to the present disclosure.

Figure 7:
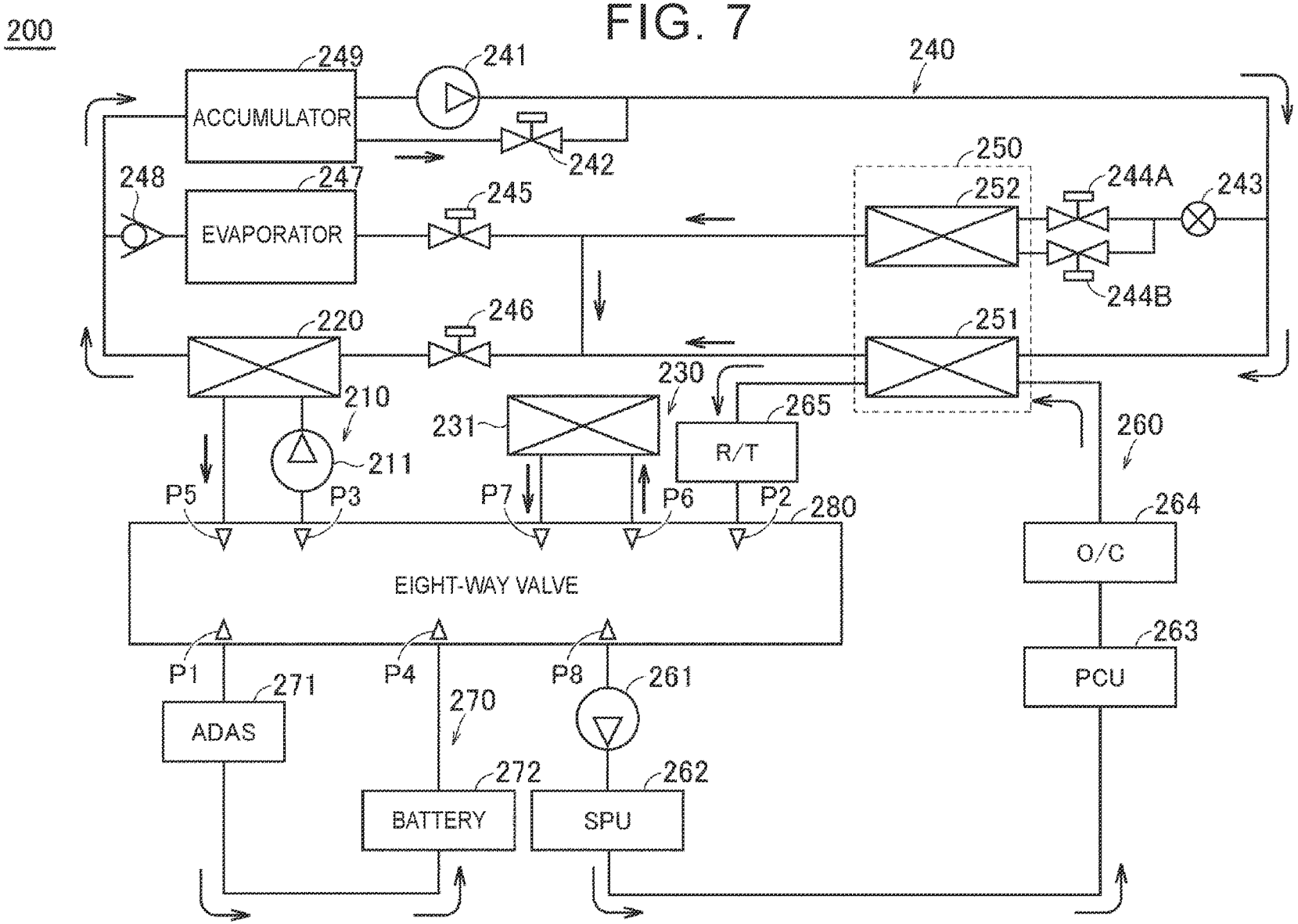
FIG. 7 illustrates the detailed configuration of the thermal management system according to the second embodiment.

Next, the configuration of the thermal management circuit will be described. FIG. 7 illustrates an example of the configuration of the thermal management circuit 200 according to the second embodiment. A thermal medium that circulates in the chiller circuit 210 flows through a path of eight-way valve 280 (port P3)—water pump 211—chiller 220—eight-way valve 280 (port P5).

The water pump 211 circulates the thermal medium in the chiller circuit 210 in accordance with a control instruction from the ECU 510. The chiller 220 exchanges heat between the thermal medium circulating in the chiller circuit 210 and the thermal medium circulating in the refrigeration cycle 240. The eight-way valve 280 switches the path to which the chiller circuit 210 is connected in accordance with a control instruction from the ECU 510. The switching of the path by the eight-way valve 280 will be discussed in detail later.

The thermal medium circulating in the radiator circuit 230 flows between the radiator 231 and the eight-way valve 280 (ports P6 and P7). The radiator 231 is disposed downstream of a grille shutter (not illustrated), and exchanges heat between the outside air and the thermal medium.

A thermal medium (gas-phase cooling medium or liquid-phase cooling medium) that circulates in the refrigeration cycle 240 flows through one of a first path of compressor 241—expansion valve 243—electromagnetic valves 244 (244A, 244B)—air-cooled condenser 252—electromagnetic valve 245—evaporator 247—orifice 248—accumulator 249—compressor 241, a second path of compressor 241—air-cooled condenser 252—electromagnetic valve 246—chiller 220—accumulator 249—compressor 241, and a third path of compressor 241—expansion valve 243—electromagnetic valves 244 (244A, 244B)—air-cooled condenser 252—electromagnetic valve 246—chiller 220—accumulator 249—compressor 241.

The compressor 241 compresses the gas-phase cooling medium circulating in the refrigeration cycle 240 in accordance with a control instruction from the ECU 510. The electromagnetic valve 242 is connected in parallel with the compressor 241, and adjusts the amount of the gas-phase cooling medium flowing into the compressor 241 in accordance with a control instruction from the ECU 510. The expansion valve 243 decompresses the liquid-phase cooling medium by expanding the liquid-phase cooling medium at a high pressure compressed by the compressor 241. The electromagnetic valves 244 (244A, 244B) switch on and off the flow of the liquid-phase cooling medium between the expansion valve 243 and the air-cooled condenser 252 in accordance with a control instruction from the ECU 510. The air-cooled condenser 252 exchanges heat with the water-cooled condenser 251 of the drive unit circuit 260. The electromagnetic valve 245 restricts the flow of the liquid-phase cooling medium into the evaporator 247 in accordance with a control instruction from the ECU 510. The electromagnetic valve 246 restricts the flow of the liquid-phase cooling medium into the chiller 220 in accordance with a control instruction from the ECU 510. The orifice 248 decompresses the cooling medium from the evaporator 247. The accumulator 249 suppresses the liquid-phase cooling medium being drawn into the compressor 241 when the cooling medium is not completely evaporated by the evaporator 247.

A thermal medium (coolant) that circulates in the drive unit circuit 260 flows through a path of eight-way valve 280 (port P8)—water pump 261—SPU 262—PCU 263—oil cooler 264—water-cooled condenser 251—reservoir tank 265—eight-way valve 280 (port P2).

The water pump 261 circulates the thermal medium in the drive unit circuit 260 in accordance with a control instruction from the ECU 510. The SPU 262 controls charge and discharge of the battery 272 in accordance with a control instruction from the ECU 510. The PCU 263 converts DC power supplied from the battery 272 into AC power and supplies the AC power to a motor (not illustrated) built in a transaxle in accordance with a control instruction from the ECU 510. The oil cooler 264 cools the transaxle through heat exchange between the thermal medium circulating in the drive unit circuit 260 and lubricating oil for the motor. The SPU 262, the PCU 263, and the oil cooler 264 are cooled by the thermal medium circulating in the drive unit circuit 260. The water-cooled condenser 251 exchanges heat with the air-cooled condenser 252 of the refrigeration cycle 240. The reservoir tank 265 maintains the pressure and the amount of the thermal medium in the drive unit circuit 260 by storing a part of the thermal medium in the drive unit circuit 260 (thermal medium flowing out along with a pressure rise).

A thermal medium (coolant) that circulates in the battery circuit 270 flows through a path of eight-way valve 280 (port P1)—ADAS 271—battery 272—eight-way valve 280 (port P4).

The ADAS 271 includes adaptive cruise control (ACC), auto speed limiter (ASL), lane keeping assist (LKA), pre-crash safety (PCS), and lane departure alert (LDA), for example. The battery circuit 270 may include autonomous driving system (ADS) in addition to the ADAS 271. The battery 272 supplies power for travel to the motor built in the transaxle.

Figure 8:
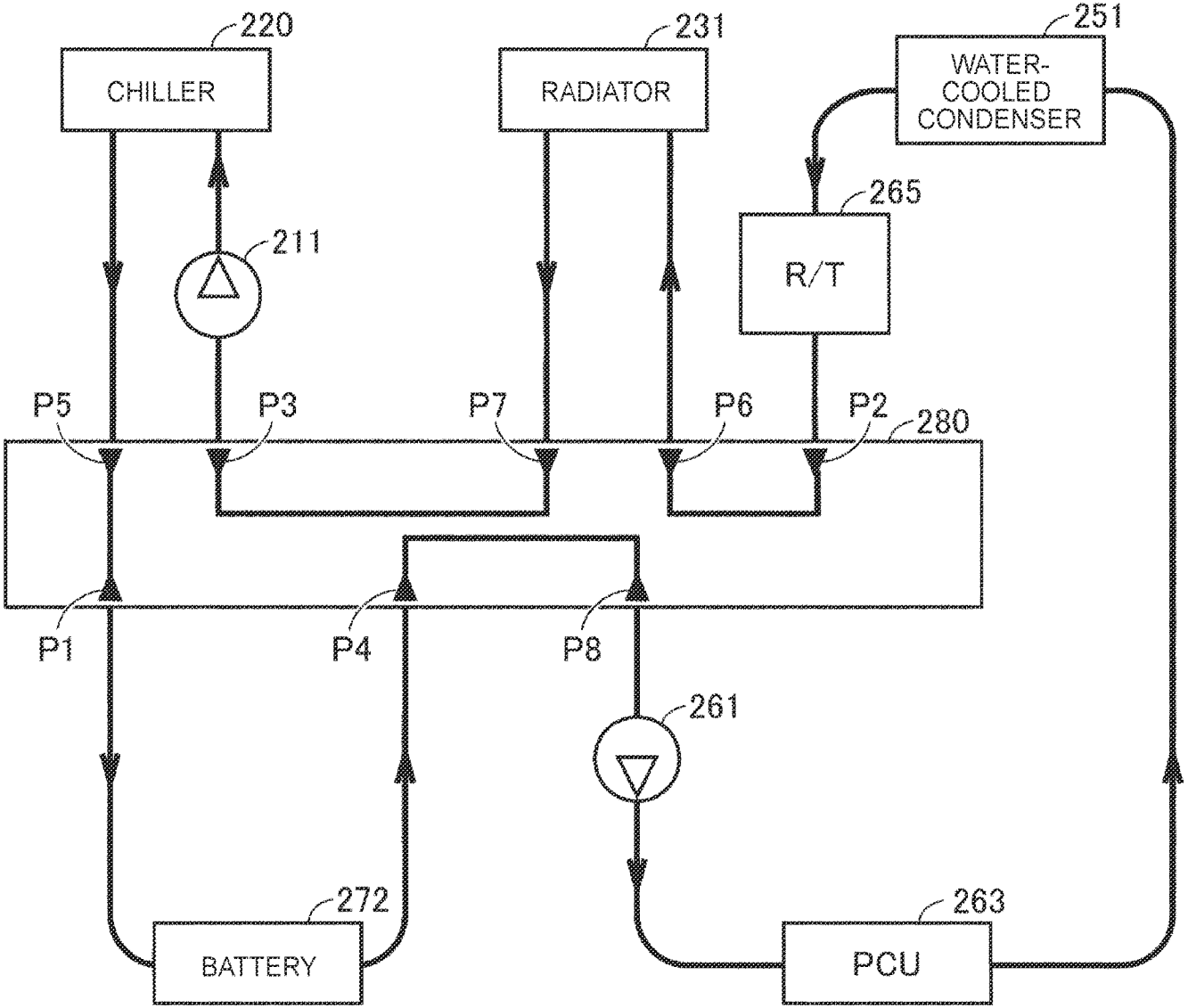
FIG. 8 illustrates an example of the configuration of a thermal management circuit according to the second embodiment in a series connection state.
Figure 9:
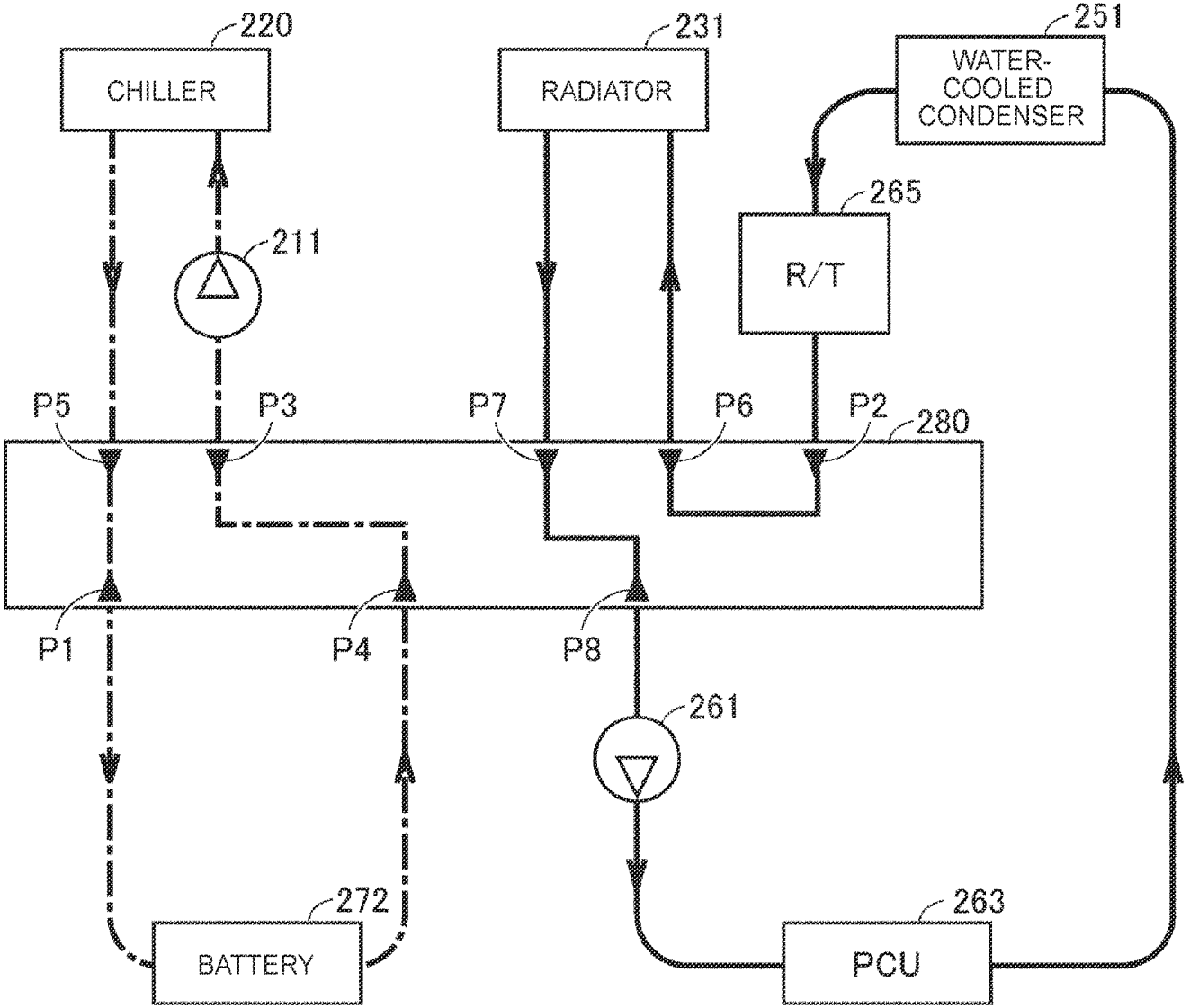
FIG. 9 illustrates an example of the configuration of the thermal management circuit according to the second embodiment in a non-series connection state.

Next, communication patterns will be described. FIGS. 8 and 9 are each a conceptual diagram illustrating an overview of a first communication pattern and a second communication pattern of the eight-way valve 280. In the first communication pattern (see FIG. 8), the eight-way valve 280 forms a path that communicates between the port P5 and the port P1, a path that communicates between the port P4 and the port P8, a path that communicates between the port P2 and the port P6, and a path that communicates between the port P7 and the port P3. In this case, the battery circuit 270, the drive unit circuit 260, the radiator circuit 230, and the chiller circuit 210 are all connected in series with each other. As a result, the thermal management circuit 200 is in the series connection state in which the reservoir tank 265, the water pump 211, and the water pump 261 are connected in series with each other. In this case, the water pump 211 is provided upstream of the water pump 261 with the reservoir tank 265 as the start point in the direction of flow of the thermal medium.

In the second communication pattern (see FIG. 9), the eight-way valve 280 forms a path that communicates between the port P5 and the port P1, a path that communicates between the port P4 and the port P3, a path that communicates between the port P7 and the port P8, and a path that communicates between the port P2 and the port P6. Consequently, the battery circuit 270 and the chiller circuit 210 are connected in series with each other, and the drive unit circuit 260 and the radiator circuit 230 are connected in series with each other. The series connection circuit of the battery circuit 270 and the chiller circuit 210 and the series connection circuit of the drive unit circuit 260 and the radiator circuit 230 are provided in parallel with each other.

Figure 10:
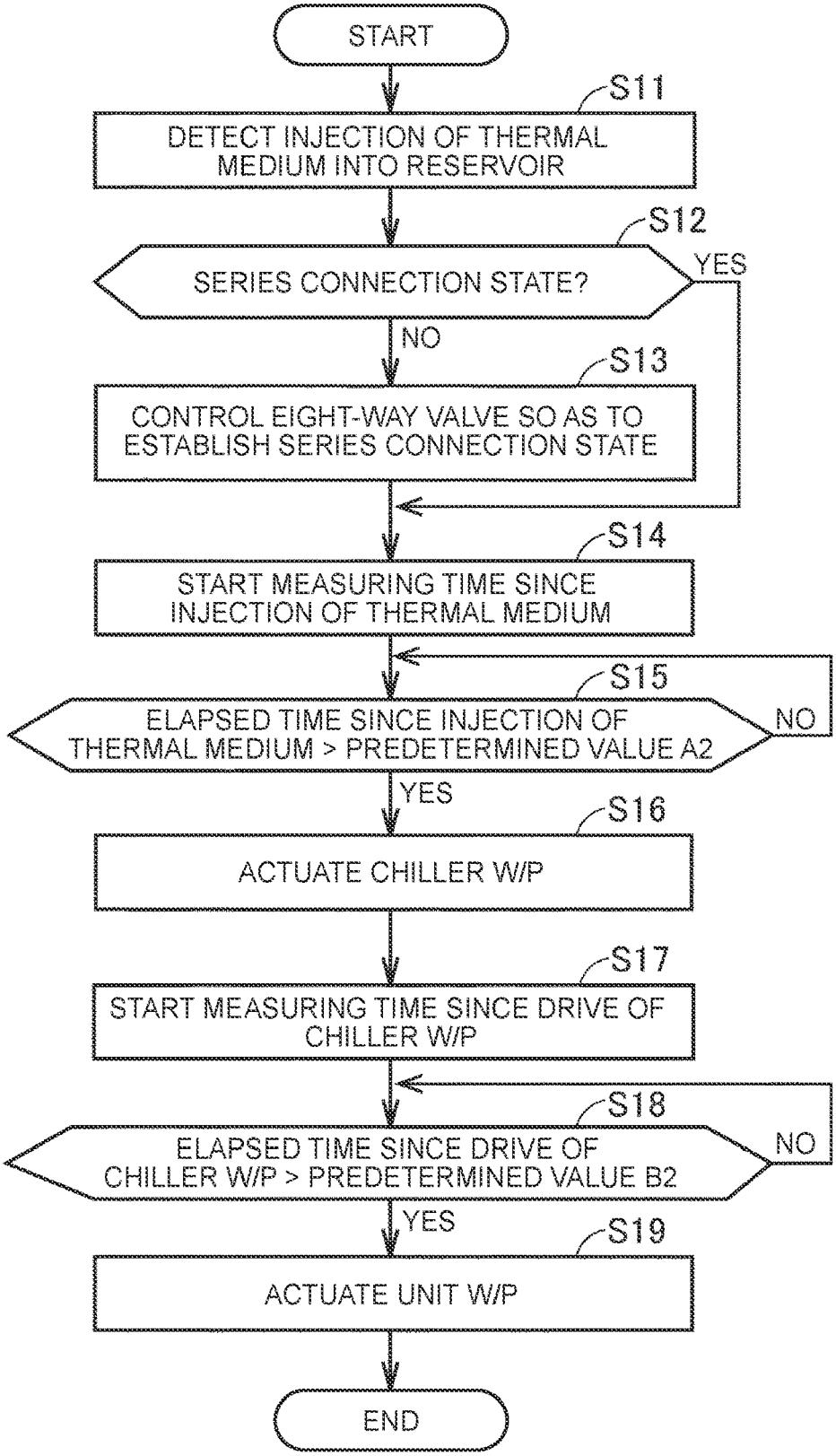
FIG. 10 is a flowchart illustrating a control flow for the thermal management system according to the second embodiment.

Next, a control method for the thermal management circuit will be described. A control method for the thermal management circuit 200 (drive method for the water pump 211 and the water pump 261) will be described with reference to the flowchart in FIG. 10.

In step S11, the ECU 510 (processor 511) detects that a thermal medium has been injected into the reservoir tank 265 in response to the HMI 600 receiving a predetermined operation by an operator, for example.

In step S12, the ECU 510 determines whether the thermal management circuit 200 is in the series connection state (see FIG. 8). For example, the ECU 510 determines whether the thermal management circuit 200 is in the series connection state based on the state of the eight-way valve 280. When the thermal management circuit 200 is in the series connection state (see FIG. 8) (Yes in S12), the process proceeds to step S14. When the thermal management circuit 200 is in the non-series connection state (see FIG. 9) (No in S12), the process proceeds to step S13. The thermal medium may be injected in circuitry other than that in FIG. 8 if the reservoir tank 265, the water pump 211, and the water pump 261 are connected in series with each other.

In step S13, the ECU 510 controls the eight-way valve 280 such that the thermal management circuit 200 is in the series connection state.

In step S14, the ECU 510 controls the timer 515 so as to start measuring the time since injection of the thermal medium into the reservoir tank 265 is detected in S11.

In step S15, the ECU 510 determines whether the elapsed time since injection of the thermal medium into the reservoir tank 265 is detected, measurement of which by the timer 515 has been started in step S14, is greater than the predetermined value A2. When the elapsed time is greater than the predetermined value A2 (Yes in S15), the process proceeds to step S16. When the elapsed time is not greater than the predetermined value A2 (No in S15), the process in step S15 is repeatedly performed. The predetermined value A2 is a value that is equal to or more than the time required for the thermal medium to reach the water pump 211 since the thermal medium is injected into the reservoir tank 265. The predetermined value A2 may be a value set in advance based on the results of experiments at the time of manufacture of the thermal management system 2. The processor 511 acquires information on the predetermined value A2 stored in the memory 512 of the ECU 510 to perform the above control. The predetermined value A2 is an example of a "second predetermined time" according to the present disclosure.

In step S16, the ECU 510 drives the upstream water pump 211 (chiller W/P).

In step S17, the ECU 510 controls the timer 515 so as to start measuring the time since the water pump 211 is driven in response to the process in step S16. Specifically, the ECU 510 starts measuring the time using the timer 515 at the timing when a signal indicating that the water pump 211 is driven is received (acquired) from the thermal management circuit 200.

In step S18, the ECU 510 determines whether the elapsed time since the water pump 211 is driven, measurement of which by the timer 515 has been started in step S17, is greater than the predetermined value B2. When the elapsed time is greater than the predetermined value B2 (Yes in S18), the process proceeds to step S19. When the elapsed time is not greater than the predetermined value B2 (No in S18), the process in step S18 is repeatedly performed. The predetermined value B2 is a value that is sufficiently greater than the time required for the thermal medium to reach the water pump 261 after being discharged from the water pump 211. The predetermined value B2 may be a value set in advance based on the results of experiments at the time of manufacture of the thermal management system 2. The processor 511 acquires information on the predetermined value B2 stored in the memory 512 of the ECU 510 to perform the above control. The predetermined value B2 is an example of a "first predetermined time" according to the present disclosure.

In step S19, the ECU 510 drives the downstream water pump 261 (unit W/P).

Other configurations and effects of the second embodiment are the same as those of the first embodiment, and thus are not repeatedly described.

Next, a thermal management system according to a third embodiment of the present disclosure will be described below. Next, a thermal management circuit 300 according to the third embodiment will be described with reference to FIGS. 11 and 12. In the third embodiment, pumps are driven based on the result of detection by a pressure sensor, unlike the first embodiment in which the water pump 131 and the water pump 171 are each driven based on the time measured by the timer 505. The same components as those according to the first embodiment are denoted by the same signs, and description thereof will not be repeated.

Figure 11:
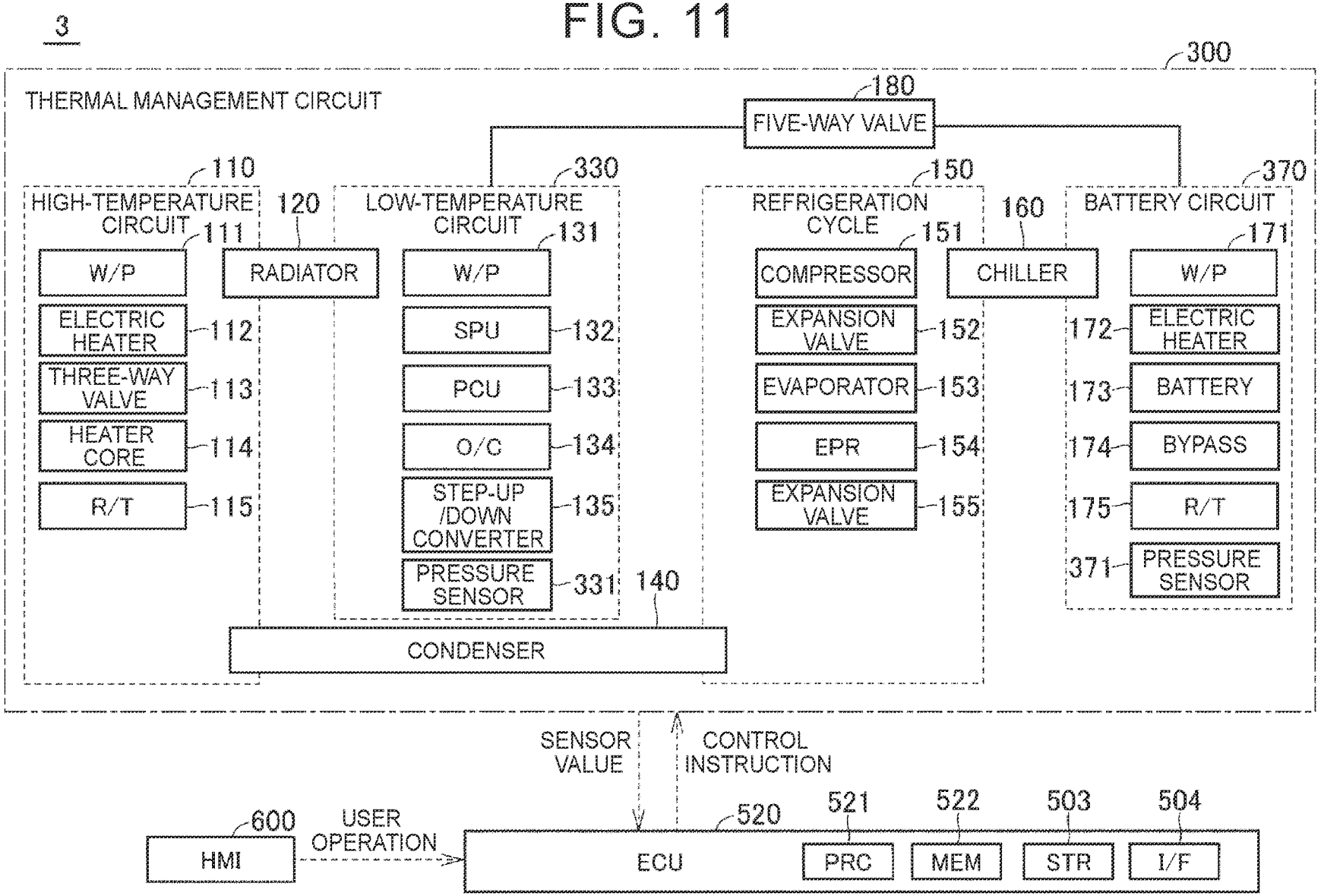
FIG. 11 illustrates the configuration of a thermal management system according to a third embodiment of the present disclosure.
Figure 12:
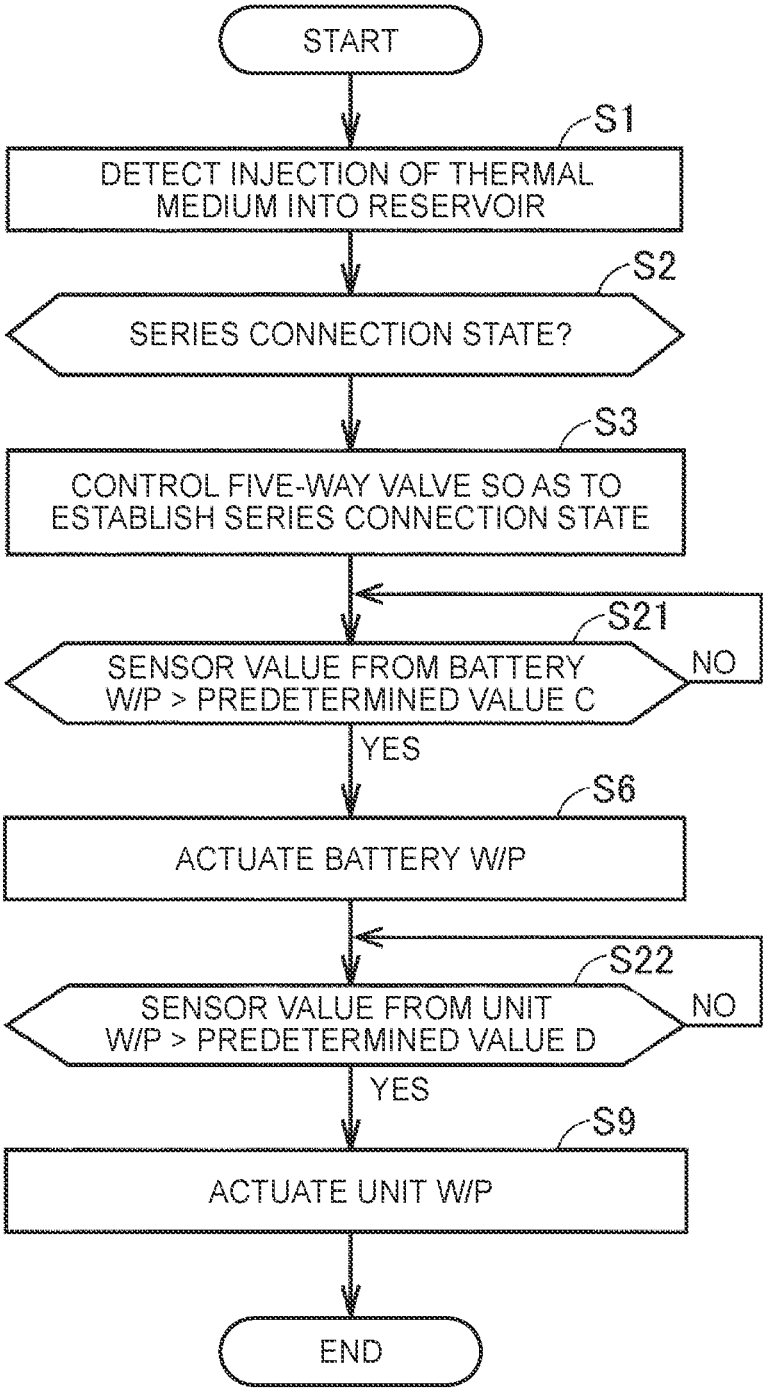
FIG. 12 is a flowchart illustrating a control flow for the thermal management system according to the third embodiment.

The overall configuration of the thermal management system according to the third embodiment of the present disclosure will be described. FIG. 11 illustrates the configuration of a thermal management system 3 according to the third embodiment. The thermal management system 3 includes a thermal management circuit 300 in place of the thermal management circuit 100 of the thermal management system 1 according to the first embodiment. The thermal management system 3 includes an ECU 520 in place of the ECU 500 according to the first embodiment. The ECU 520 is an example of an "electronic control unit" according to the present disclosure.

The thermal management circuit 300 includes a low-temperature circuit 330 in place of the low-temperature circuit 130 of the thermal management circuit 300 according to the first embodiment. The thermal management circuit 300 includes a battery circuit 370 in place of the battery circuit 170 of the thermal management circuit 300 according to the first embodiment.

The low-temperature circuit 330 includes a pressure sensor 331 in addition to the components of the low-temperature circuit 130 according to the first embodiment. The pressure sensor 331 is provided at an in-flow port (not illustrated) of the water pump 131 for a thermal medium, for example. Thus, a detected value from the pressure sensor 331 is varied in response to the thermal medium reaching the water pump 131. That is, the pressure sensor 331 can detect that the thermal medium has reached the water pump 131. The pressure sensor 331 is an example of a "detection unit" according to the present disclosure.

The battery circuit 370 includes a pressure sensor 371 in addition to the components of the battery circuit 170 according to the first embodiment. The pressure sensor 371 is provided at an in-flow port (not illustrated) of the water pump 171 for a thermal medium, for example. Thus, a detected value from the pressure sensor 371 is varied in response to the thermal medium reaching the water pump 171. That is, the pressure sensor 371 can detect that the thermal medium has reached the water pump 171.

The ECU 520 includes a processor 521 in place of the processor 501 of the ECU 500 according to the first embodiment. In addition, the ECU 520 includes a memory 522 in place of the memory 502 of the ECU 500 according to the first embodiment. The ECU 520 is not provided with the timer 505 according to the first embodiment.

The ECU 520 (processor 521) drives the water pump 171 in response to the pressure sensor 371 detecting that the thermal medium has reached the water pump 171 on condition that the thermal management circuit 300 is in the series connection state when the thermal medium is injected into the reservoir tank 175.

Specifically, the ECU 520 drives the water pump 171 when the detected value from the pressure sensor 371 exceeds a predetermined value C on condition that the thermal management circuit 300 is in the series connection state when the thermal medium is injected into the reservoir tank 175. The predetermined value C is a value between a pressure applied to the in-flow port of the water pump 171 with the water pump 171 not reached by the thermal medium and a pressure applied to the in-flow port of the water pump 171 with the water pump 171 reached by the thermal medium (e.g. an average value of the two pressure values). The predetermined value C may be a value set in advance based on the results of experiments at the time of manufacture of the thermal management system 3. Consequently, the water pump 171 is driven at the timing when the thermal medium reaches the water pump 171. The processor 521 acquires information on the predetermined value C stored in the memory 522 of the ECU 520 to perform the above control. The predetermined value C may be determined using a learned model generated by a machine learning technique such as deep learning.

The ECU 520 (processor 521) drives the water pump 131 in response to the pressure sensor 331 detecting that the thermal medium has reached the water pump 131 on condition that the thermal management circuit 300 is in the series connection state when the thermal medium is injected into the reservoir tank 175.

Specifically, the ECU 520 drives the water pump 131 when the detected value from the pressure sensor 331 exceeds a predetermined value D on condition that the thermal management circuit 300 is in the series connection state when the thermal medium is injected into the reservoir tank 175. The predetermined value D is a value between a pressure applied to the in-flow port of the water pump 131 with the water pump 131 not reached by the thermal medium and a pressure applied to the in-flow port of the water pump 131 with the water pump 131 reached by the thermal medium (e.g. an average value of the two pressure values). The predetermined value D may be a value set in advance based on the results of experiments at the time of manufacture of the thermal management system 3. Consequently, the water pump 131 is driven at the timing when the thermal medium reaches the water pump 131. The processor 521 acquires information on the predetermined value D stored in the memory 522 of the ECU 520 to perform the above control. The predetermined value D may be determined using a learned model generated by a machine learning technique such as deep learning.

Next, a control method for the thermal management circuit will be described. A control method for the thermal management circuit 300 (drive method for the water pump 131 and the water pump 171) will be described with reference to the flowchart in FIG. 12. The same process steps as those according to the first embodiment are denoted by the same signs, and description thereof will not be repeated.

The process in step S21 is performed after step S3. In step S21, the ECU 520 (processor 521) determines whether the detected value from the pressure sensor 371 provided at the in-flow port of the water pump 171 (battery W/P) is greater than the predetermined value C. When the detected value from the pressure sensor 371 is greater than the predetermined value C (Yes in S21), the process proceeds to step S6. When the detected value from the pressure sensor 371 is not greater than the predetermined value C (No in S21), the process in step S21 is repeatedly performed.

The process in step S22 is performed after step S6. In step S22, the ECU 520 determines whether the detected value from the pressure sensor 331 provided at the in-flow port of the water pump 131 (unit W/P) is greater than the predetermined value D. When the detected value from the pressure sensor 331 is greater than the predetermined value D (Yes in S22), the process proceeds to step S9. When the detected value from the pressure sensor 331 is not greater than the predetermined value D (No in S22), the process in step S22 is repeatedly performed.

Other configurations and effects of the third embodiment are the same as those of the first embodiment, and thus are not repeatedly described.

While the thermal medium is injected into the reservoir tank with two pumps connected in series with each other in the first to third embodiments, the present disclosure is not limited thereto. The thermal medium may be injected into the reservoir tank with three or more pumps connected in series with each other. In this case, the pumps are driven sequentially from the upstream side with the reservoir tank as the start point. In addition, a plurality of reservoir tanks may be provided in the series connection circuit.

While two pumps are driven on condition that the two pumps are switched into the series connection state in the first to third embodiments, the present disclosure is not limited thereto. For example, the two pumps may be switched into the series connection state after (preferably immediately after) the upstream pump is driven.

While the downstream pump is driven after the thermal medium reaches the downstream pump in the first to third embodiments, the present disclosure is not limited thereto. For example, drive of the downstream pump may be started immediately before the thermal medium reaches the downstream pump. In addition, drive of the upstream pump may be started immediately before the thermal medium reaches the upstream pump.

While drive of the pumps is controlled based on a detected value from a pressure sensor in the third embodiment, the present disclosure is not limited thereto. A temperature (liquid temperature) sensor may be used in place of the pressure sensor, for example.

Alternatively, one of the upstream pump and the downstream pump may be driven based on a time measured by a timer, and the other of the upstream pump and the downstream pump may be driven based on a detected value from a sensor (pressure sensor or liquid temperature sensor).

While control is performed such that the upstream pump is driven with the thermal medium flowing through the upstream pump in the first to third embodiments, the present disclosure is not limited thereto. The timing to drive the upstream pump may not be controlled.

The configurations (processes) of the above embodiments and the above modifications may be combined with each other.

The embodiments disclosed herein should be construed as illustrative in all respects and not limiting. The scope of the present disclosure is set forth by the claims rather than by the above description of the embodiments, and is intended to include all modifications within the meaning and scope equivalent to those of the claims.

What is claimed is:

1. A thermal management system for a vehicle with a battery mounted in the vehicle, comprising:

a thermal management circuit including a reservoir into which a thermal medium is injected, a first pump, a second pump, and the battery, and configured to allow the thermal medium to flow through the thermal management circuit;

a processor configured to control drive of each of the first pump and the second pump, wherein the first pump is upstream of the second pump in a direction of flow of the thermal medium with the reservoir as a start point when the thermal management circuit is in a series connection state in which the reservoir, the first pump, and the second pump are connected in series with each other, and the processor is configured to drive the first pump earlier than the second pump on condition that the thermal management circuit is in the series connection state when the thermal medium is injected into the reservoir; and a valve configured to switch the thermal management circuit between the series connection state and a non-series connection state in which the first pump and the second pump are not connected in series with each other, and to be controlled by the processor, wherein the processor is configured to drive each of the first pump and the second pump on condition that the thermal management circuit is switched from the non-series connection state to the series connection state by controlling the valve.

2. The thermal management system according to claim 1, wherein the processor is configured to drive the second pump while the thermal medium that has flowed through the first pump is flowing through the second pump on condition that the thermal management circuit is in the series connection state when the thermal medium is injected into the reservoir.

3. The thermal management system according to claim 1, further comprising a first timer configured to measure a time since the first pump is driven, wherein:

the processor is configured to acquire information about a first predetermined time based on a time required for the thermal medium to flow from the first pump to the second pump; and the processor is configured to drive the second pump in response to the time measured by the first timer exceeding the first predetermined time on condition that the thermal management circuit is in the series connection state when the thermal medium is injected into the reservoir.

4. The thermal management system according to claim 1, further comprising a detection unit configured to detect that the thermal medium has reached the second pump, wherein the processor is configured to drive the second pump in response to the detection unit detecting that the thermal medium has reached the second pump on condition that the thermal management circuit is in the series connection state when the thermal medium is injected into the reservoir.

5. The thermal management system according to claim 4, wherein:

the detection unit is a pressure sensor or a liquid temperature sensor; and the processor is configured to drive the second pump in response to the pressure sensor or the liquid temperature sensor detecting that the thermal medium has reached the second pump on condition that the thermal management circuit is in the series connection state when the thermal medium is injected into the reservoir.

6. A thermal management system comprising:

a thermal management circuit including a reservoir into which a thermal medium is injected, a first pump, and a second pump, and configured to allow the thermal medium to flow through the thermal management circuit;

a processor configured to control drive of each of the first pump and the second pump, wherein the first pump is upstream of the second pump in a direction of flow of the thermal medium with the reservoir as a start point when the thermal management circuit is in a series connection state in which the reservoir, the first pump, and the second pump are connected in series with each other, and the processor is configured to drive the first pump earlier than the second pump on condition that the thermal management circuit is in the series connection state when the thermal medium is injected into the reservoir;

a valve configured to switch the thermal management circuit between the series connection state and a non-series connection state in which the first pump and the second pump are not connected in series with each other, and to be controlled by the processor, and a first timer configured to measure a time since the first pump is driven, wherein:

the processor is configured to drive each of the first pump and the second pump on condition that the thermal management circuit is switched from the non-series connection state to the series connection state by controlling the valve, the processor is configured to acquire information about a first predetermined time based on a time required for the thermal medium to flow from the first pump to the second pump, and the processor is configured to drive the second pump in response to the time measured by the first timer exceeding the first predetermined time on condition that the thermal management circuit is in the series connection state when the thermal medium is injected into the reservoir.

7. A thermal management system comprising:

a thermal management circuit including a reservoir into which a thermal medium is injected, a first pump, and a second pump, and configured to allow the thermal medium to flow through the thermal management circuit;

a processor configured to control drive of each of the first pump and the second pump, wherein the first pump is upstream of the second pump in a direction of flow of the thermal medium with the reservoir as a start point when the thermal management circuit is in a series connection state in which the reservoir, the first pump, and the second pump are connected in series with each other, and the processor is configured to drive the first pump earlier than the second pump on condition that the thermal management circuit is in the series connection state when the thermal medium is injected into the reservoir;

a valve configured to switch the thermal management circuit between the series connection state and a non-series connection state in which the first pump and the second pump are not connected in series with each other, and to be controlled by the processor, and a second timer configured to measure a time since the thermal medium is injected into the reservoir, wherein:

the processor is configured to drive each of the first pump and the second pump on condition that the thermal management circuit is switched from the non-series connection state to the series connection state by controlling the valve, the processor is configured to drive the first pump while the thermal medium is flowing through the first pump on condition that the thermal management circuit is in the series connection state when the thermal medium is injected into the reservoir, the processor is configured to acquire information about a second predetermined time based on a time required for the thermal medium to flow from the reservoir to the first pump, and the processor is configured to drive the first pump in response to the time measured by the second timer exceeding the second predetermined time on condition that the thermal management circuit is in the series connection state when the thermal medium is injected into the reservoir.

8. A thermal management system for a vehicle with a battery mounted in the vehicle, comprising:

a thermal management circuit including a reservoir into which a thermal medium is injected, a plurality of pumps, and the battery, and configured to allow the thermal medium to flow through the thermal management circuit;

a processor configured to control drive of each of the plurality of pumps, wherein the plurality of pumps include a most upstream pump most upstream in a direction of flow of the thermal medium with the reservoir as a start point when the thermal management circuit is in a series connection state in which the reservoir and the plurality of pumps are connected in series with each other, and the processor is configured to drive the most upstream pump first, among the plurality of pumps, on condition that the thermal management circuit is in the series connection state when the thermal medium is injected into the reservoir; and a valve configured to switch the thermal management circuit between the series connection state and a non-series connection state in which the plurality of pumps are not connected in series with each other, and to be controlled by the processor, wherein the processor is configured to drive each of the plurality of pumps on condition that the thermal management circuit is switched from the non-series connection state to the series connection state by controlling the valve.

9. The thermal management system according to claim 8, wherein the processor is configured to drive the plurality of pumps sequentially from an upstream side in the direction of flow on condition that the thermal management circuit is in the series connection state when the thermal medium is injected into the reservoir.

10. A control method for a thermal management system for a vehicle with a battery mounted in the vehicle, the thermal management system including a thermal management circuit including a reservoir into which a thermal medium is injected, a first pump, a second pump, and the battery, and configured to allow the thermal medium to flow through the thermal management circuit, the first pump being upstream of the second pump with respect to the reservoir in a direction of flow of the thermal medium when the thermal management circuit is in a series connection state in which the reservoir, the first pump, and the second pump are connected in series with each other; and a valve configured to switch the thermal management circuit between the series connection state and a non-series connection state in which the first pump and the second pump are not connected in series with each other, the control method comprising:

injecting the thermal medium into the reservoir on condition that the thermal management circuit is in the series connection state;

driving the first pump earlier than the second pump when the thermal medium is injected into the reservoir in the injecting of the thermal medium; and driving each of the first pump and the second pump on condition that the thermal management circuit is switched from the non-series connection state to the series connection state by controlling the valve.

* * * * *